US011866230B1

(12) United States Patent
Wilcox

(10) Patent No.: US 11,866,230 B1
(45) Date of Patent: Jan. 9, 2024

(54) HYDRATION TUBE QUICK CONNECT CONTAINER LID FOR A DRINKING CONTAINER

(71) Applicant: Russell M. Wilcox, Mariposa, CA (US)

(72) Inventor: Russell M. Wilcox, Mariposa, CA (US)

( * ) Notice: Subject to any disclaimer, the term of this patent is extended or adjusted under 35 U.S.C. 154(b) by 476 days.

(21) Appl. No.: 16/432,322

(22) Filed: Jun. 5, 2019

Related U.S. Application Data

(60) Provisional application No. 62/781,237, filed on Dec. 18, 2018, provisional application No. 62/680,593, filed on Jun. 5, 2018.

(51) Int. Cl.
*B65D 41/26* (2006.01)
*A47G 21/18* (2006.01)
*B65D 41/04* (2006.01)

(52) U.S. Cl.
CPC ..... *B65D 41/265* (2013.01); *A47G 21/18* (2013.01); *B65D 41/0407* (2013.01); *B65D 2251/06* (2013.01); *B65D 2251/205* (2013.01)

(58) Field of Classification Search
CPC ..... A47G 21/18; A47G 19/2266; A61J 9/006; B65D 47/04; B65D 47/06; B65D 47/24
See application file for complete search history.

(56) References Cited

U.S. PATENT DOCUMENTS

| | | | | |
|---|---|---|---|---|
| 6,082,583 A * | 7/2000 | Bussell | A47G 19/2266 | 220/739 |
| 6,523,711 B1 * | 2/2003 | Hughes | A47G 19/2266 | 215/308 |
| 7,073,688 B2 * | 7/2006 | Choi | A45F 3/20 | 141/379 |
| 2004/0060598 A1 * | 4/2004 | Danby | B65D 47/2068 | 137/508 |

* cited by examiner

*Primary Examiner* — Andrew T Kirsch
(74) *Attorney, Agent, or Firm* — Richard A. Ryan

(57) ABSTRACT

A container lid for use to drink liquid from a drinking container using a hydration tube. The container lid has a cap member that attaches to the container, a coupling aperture through the cap member, a female coupling positioned in the coupling aperture, a male insert that is removably received in the female coupling and a check valve in the cap member. The hydration tube attaches to an upwardly extending barb of the male insert and an internal straw attaches to a downwardly extending barb of the female coupling to extend into the interior of the container. The male insert has a sealing section with a sealing device that is sealably received in a receptacle of the female coupling. The container lid allows the user to easily, quickly and without leaking remove the hydration tube from the lid to replace an empty drinking container with a full drinking container.

20 Claims, 5 Drawing Sheets

HYDRATION TUBE QUICK CONNECT CONTAINER LID FOR A DRINKING CONTAINER

CROSS-REFERENCE TO RELATED APPLICATIONS

This patent application claims priority to U.S. Provisional Patent Application Ser. No. 62/781,237 filed Dec. 18, 2018 and U.S. Provisional Patent Application Ser. No. 62/680,593 filed Jun. 5, 2018.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses and systems that are utilized by a person to stay hydrated. In particular, the present invention relates to such apparatuses and systems that are specially adapted to allow a person to drink water or other liquids from a solid-walled container through a tube that passes through a lid which is attached to the container. Even more particularly, the present invention relates to such apparatuses and systems that allow a person to easily and quickly connect and disconnect the tube from the lid while preventing leaks from the container, lid or tube.

B. Background

People frequently engage in activities, some of which may be quite intense, where it is necessary for him or her to maintain a sufficient or safe level of hydration while he or she is engaged in the activity. One manner in which a person maintains sufficient hydration is to drink water or other fluids from a container that is specifically sized and configured to be portable so that he or she may be able to access the container and drink fluid from the container while engaged in an activity. There are many different types of containers that are presently utilized for drinking fluids. The most common configuration for such containers is to have a container body made up of one or more container walls, an interior chamber that is enclosed by the container walls, an opening defined by the container walls through which liquid is placed into the interior chamber and removed therefrom and a lid that removably closes the opening to prevent accidental loss of liquid from the container.

In one configuration, the user must remove the lid from the container body to drink liquid from the container at the opening into the interior chamber thereof. In other configurations, the container has a drinking mechanism that is configured to allow the user to drink liquid from the container without removing the lid. Some drinking mechanisms have a spout in the lid which is pivoted to an open position for drinking liquid and to a closed position for preventing loss of liquid from the container. Other drinking mechanisms comprise a tube, commonly referred to as a hydration tube, that passes through an aperture in the lid, or elsewhere on the container, into the interior chamber. For ease of access to the liquid and to easily drink liquid from the container while the container is being carried, such as in a backpack, bag or the like, the tube will extend outwardly from the container, often for two to three feet or more. These containers have an open/close mechanism that is placed in an open position for drinking liquid from the tube and a closed position to prevent loss of liquid through the tube.

Currently there are a number of solutions for drinking liquid from a container through a hydration tube associated with the container. Some of these solutions utilize a soft-walled drinking pouch. Unfortunately, soft-walled drinking pouches commonly fail to meet the needs of the users, particularly those who are engaged in certain types of activities, such as firefighting and the like, because the pouch containers are not configured to maintain the liquid contents at a desired temperature. As is well known to persons in the art, the contents of these pouch containers will always quickly equalize to the ambient temperature, which can be quite warm. In addition, the soft-walled body of these pouch containers are configured such that the soft, flexible walls can easily be breached by contact with branches, pipes and other objects. From a cleanliness standpoint, the inner surfaces of the soft, flexible walls which define the interior chamber of a container pouch can be very difficult to clean. Also, the flavor of the contents in a soft-walled container pouch can change with environmental conditions. Because of the above, and possibly other reasons, many people prefer a hydration solution that includes the use of a container having hard, rigid, solid walls (hereinafter, referred to as a solid-walled container). As well known by persons skilled in the relevant art, it is generally much easier to maintain a desirable drinking temperature for liquids that are contained in a solid-walled container, the walls of the container are much less likely to be breached by contact with an object, the interior walls of the container are easier to clean and such containers are made out of materials, such as stainless steel or aluminum, that do not, or are much less likely, to change the taste of the liquid.

One solution for drinking liquid from a solid-walled container through a hydration tube is to provide a lid with an open port for the hydration tube to enter into the interior chamber of the container. However, such solutions are similarly unable to meet the needs of many people because this configuration of container does not provide a mechanism to disconnect the hydration tube from the container while maintaining a leakproof lid. Furthermore, these solutions do not provide the ability to quickly disconnect the hydration tube from an empty container and then connect the hydration tube to a separate container that is full, or at least more full, of liquid, which is often highly desirable in certain circumstances. For instance, when fire crews are fighting a fire, particularly wild fires that are burning brush and trees in a remote area, the firefighters must be supplied with drinking water and other hydration liquids on a rather frequent basis while they are actively engaged in firefighting activities. Typically, it is much easier, faster and often safer to replace an empty drinking container with a full container than it is to attempt to refill the empty container with liquid.

What is needed, therefore, is a container configuration that allows a person to drink the liquid contents of a solid-walled drinking container through a hydration tube which is able to quickly connect and disconnect from the lid and, as a result, the container. Furthermore, it would also be desirable for such a container configuration to be able to maintain the normal leakproof capabilities of a solid-walled container while the hydration tube is disconnected from the lid of the container. Still further, it would be desirable to have a container configuration that provides the ability to quickly disconnect a hydration tube from the container lid and, therefore, the container for ease of refilling the container or, as is often preferred, to quickly change out or swap the container for a container having a cooperatively configured lid which is full or at least more full of liquid. In summary, there currently exists a need in the industry for a container and associated drinking system that allows a user to drink the liquid contents from a solid-walled drinking container through a hydration tube which allows the user to be able to quickly disconnect the tube and then connect the tube to a second container having a matching lid while maintaining the leakproof capabilities of the solid-walled container.

SUMMARY OF THE INVENTION

The following presents a simplified summary of the disclosure in order to provide a basic understanding to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later. A more complete appreciation of the present invention and the scope thereof can be obtained from the accompanying drawings which are briefly summarized below and the following detailed description of the presently preferred embodiments of the present invention.

As will be readily appreciated by persons skilled in the art, the present invention provides the benefits and solves the problems that are identified above. That is to say, the apparatus and system of the present invention advantageously fills the aforementioned deficiencies by providing a leakproof hydration tube quick connect lid for a solid-walled drinking container that allows a user to drink the liquid contents of a solid-walled drinking container through a hydration tube which is associated with the container. More specifically, the apparatus and system of the present invention is an improved container lid that is configured to allow a person to drink liquid from a solid-walled drinking container through a hydration tube which is able to quickly connect and disconnect from the lid and, as a result, from the container. The new container lid and liquid drinking system are structured and arranged such that the user is able to maintain the normal leakproof capabilities of a solid-walled container when the hydration tube is disconnected from the lid of the container. In addition, the container lid and system of the present invention allows a user to be able to quickly disconnect a hydration tube from the lid and, therefore, the container to either refill the container with liquid or, as is often preferred, to quickly change out or otherwise swap the container for a second container, having a cooperatively configured lid, which is full or at least more full of liquid. The new container lid and the other components of the drinking system can be made out of a wide variety of materials, including those which are relatively lightweight and easily cleaned so the container will be portable and easy to clean. The new container lid of the present invention is readily adaptable for use with a wide variety of different configurations of containers. In the preferred configurations, the new container lid and system are relatively inexpensive to manufacture, which will allow them to be widely available and utilized.

In one embodiment of the present invention, the improved container lid is a hydration tube quick connect drinking container lid, which is made up of the following components: (1) an insulating cap member either internally or externally threaded; (2) a barbed female valved coupling body; (3) an in-line straight or elbow-shaped male insert; and (4) a one-way check valve. These components are connected as follows: the barbed female coupling is positioned in an aperture of the insulated cap member with either the in-line straight or elbow-shaped male insert being connected to the barbed female coupling and with the one-way check valve positioned in the insulating cap member. In addition, the new container lid may also have one or more of the following: (1) a hydration tube attached to a barbed end of the male insert; (2) an internal straw attached to the barbed end of the female coupling; and (3) a handle that attaches to the lid body. Similarly, a method of using the new container lid may also include one or more of the following steps: (1) attaching the hydration tube to a barbed end of the male insert;

(2) attaching a straw to the barbed end of the female coupling and extending the straw to the bottom of the container; and (3) using a handle that is attached to the lid body to more easily carry or otherwise transport the container lid and the container.

The disclosed container lid is unique when compared with other known devices and solutions because it provides: (1) an insulating cap member with a barbed female coupling that is positioned within the body of the cap member; (2) a barbed inline straight or elbow-shaped male insert which couples with the female coupling; and (3) a one-way check valve that is positioned within the cap member. Similarly, the associated method of using the new container lid is unique in that it: (1) provides the ability to drink liquid from a solid-walled drinking container through a hydration tube that allows the contents of the container to maintain the desired temperature within the container; (2) creates the ability to quickly disconnect the hydration tube from the container lid while maintaining a leakproof container and container lid; and (3) provides the ability to quickly swap or change the hydration tube from an empty container to another container that is full or more full of liquid.

In a preferred configuration, a new drinking system comprises the above-described container lid, a solid-walled container having an opening that is sized and configured for the container lid to attach to or be integral with the container, a hydration tube that connects to the lid to allow a user to easily drink fluid from the container, and an internal straw which is positioned inside the container and extends to or at least towards the bottom of the container. In one of the preferred embodiments, the system is configured such that the container lid removably, but sealably, connects to the container. In one configuration, the cap body threadably connects, with externally or internally threading, to the container.

The disclosure set forth below provides a more detailed and specific description that will make reference to the accompanying drawings. The drawings and specific descriptions of the drawings, as well as any specific or alternative embodiments discussed, are intended to be read in conjunction with the entirety of this disclosure. The hydration tube quick connect lid for a solid-walled drinking container may, however, be embodied in many different forms and should not be construed as being limited to the embodiments set forth herein. Instead, the embodiments set forth below are provided by way of illustration only and so that this disclosure will be thorough, complete and fully convey understanding to those persons who are skilled in the art.

Accordingly, the primary object of the present invention is to provide a new container lid and liquid drinking system that has the advantages set forth above and elsewhere herein and which overcomes the known disadvantages and limitations that are associated with presently available apparatuses and systems for drinking liquid from a container through a hydration tube.

It is an important object of the present invention to provide a new container lid and liquid drinking system that are specially structured and arranged to allow the user thereof to drink liquid from a solid-walled drinking container through a hydration tube and which allows the user to be able to quickly disconnect the tube from the container and then connect the tube to a second container having a matching lid while maintaining the leakproof capabilities of the container.

An important aspect of the present invention is that it provides a new container lid and liquid drinking system which accomplishes the objectives set forth above and elsewhere in the present disclosure.

Another important aspect of the present invention is that it provides a new container lid and liquid drinking system which are structured and arranged to allow a person to drink liquid from a solid-walled drinking container through a hydration tube that is able to be quickly connected to and disconnected from the lid and, as a result, the container in a manner which maintains the normal leakproof capabilities of a solid-walled container when the hydration tube is disconnected from the lid of the container.

Another important aspect of the present invention is that it provides a new container lid and liquid drinking system which are structured and arranged to allow the user thereof to quickly disconnect a hydration tube from the container lid in order to either refill the container with liquid or to quickly change out or otherwise swap an empty container for a second container, having a cooperatively configured container lid, which is full or at least more full of liquid.

Another important aspect of the present invention is that it provides a new container lid and liquid drinking system which are structured and arranged to allow the user thereof to maintain the normal leakproof capabilities of a solid-walled container when the hydration tube of the container, which is utilized to drink liquid from the container, is disconnected from the container lid.

Another important aspect of the present invention is that it provides a new container lid and liquid drinking system which is readily adaptable for use with a wide variety of different types, sizes and configurations of containers and container lids.

Yet another important aspect of the present invention is that it provides a new container lid and liquid drinking system which, in a preferred configuration, are easy to use and relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by persons who are skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the container lid of the present invention, as well as examples of containers and hydration tubes with which the new container lid may be utilized, persons who are skilled in the relevant art will readily appreciate that the present invention is not so limited. In addition, the exemplary embodiments of the present invention are shown and described herein with only those components that are required to disclose the present invention. As such, it may be possible that some of the necessary elements for attaching and using the present invention are not shown or necessarily described below, but which are well known to persons who are skilled in the relevant art. As will be readily appreciated by such persons, the various elements of the present invention that are described below may take on any form which is consistent with forms that may be understood by a person of ordinary skill in the art having knowledge of hydration containers and tubes.

Figure 1:
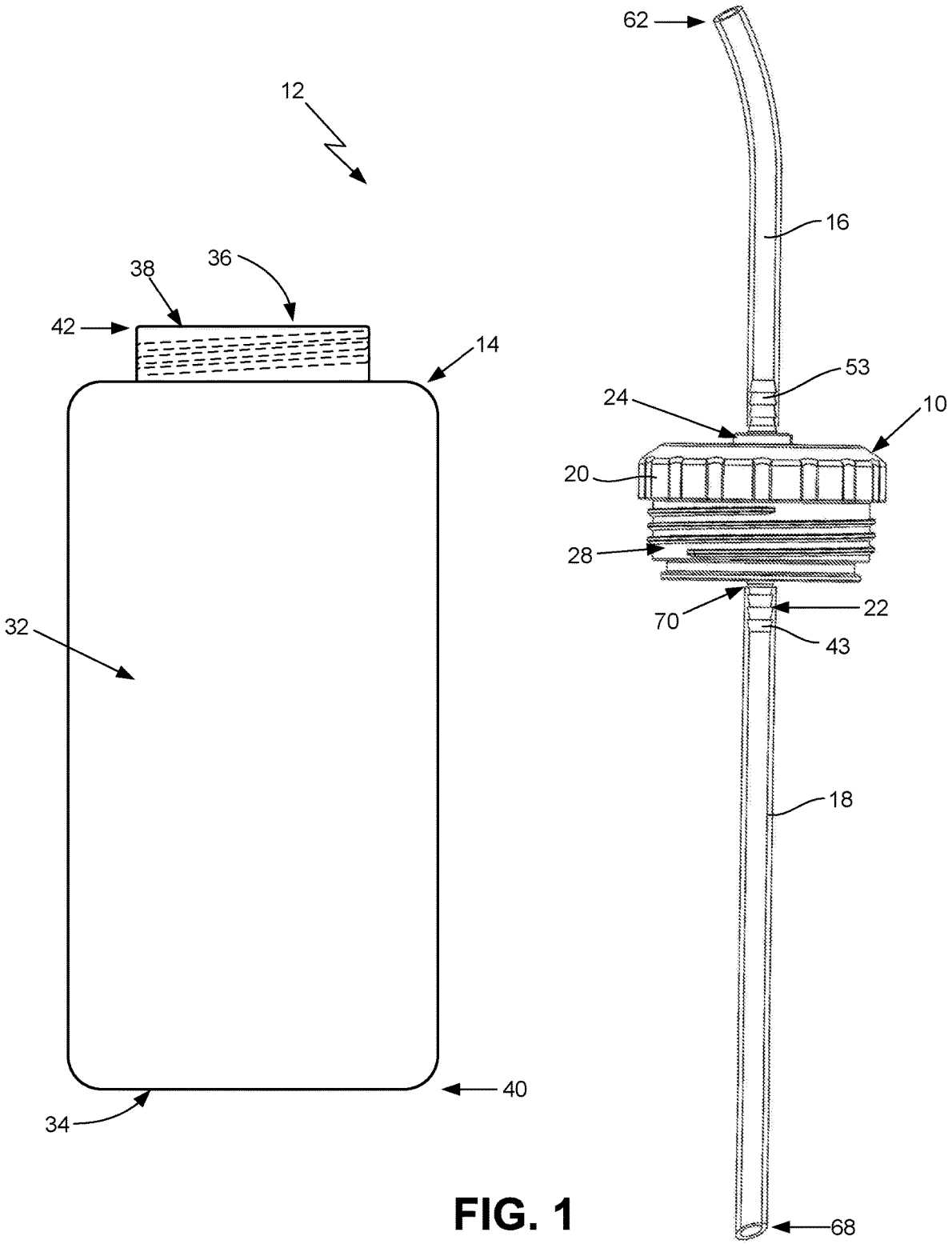
FIG. 1 is a side view of a liquid drinking system that comprises a hydration tube quick connect container lid which is configured according to a first embodiment of the present invention, a solid-walled drinking container, a hydration tube and an internal straw.
Figure 3:
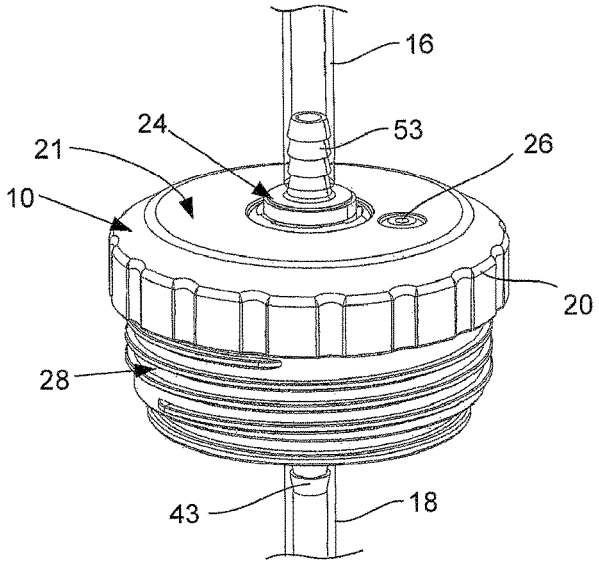
FIG. 3 is an isolated top perspective view of the container lid of FIG. 1 with portions of the hydration tube and internal straw connected thereto.
Figure 4:
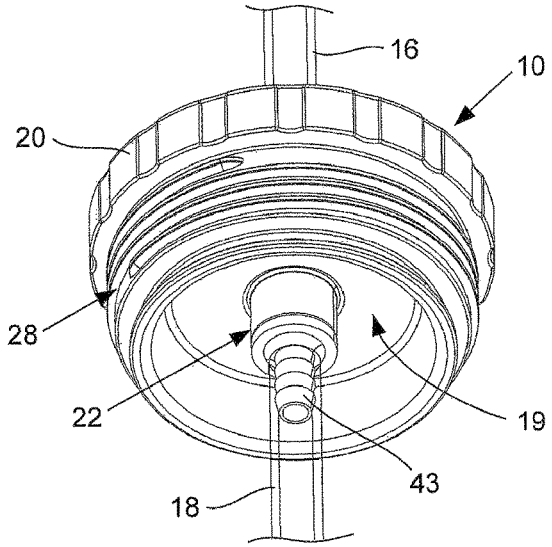
FIG. 4 a bottom perspective view of the container lid, hydration tube and internal straw of FIG. 3 particularly showing the externally threaded insulated cap member.
Figure 5:
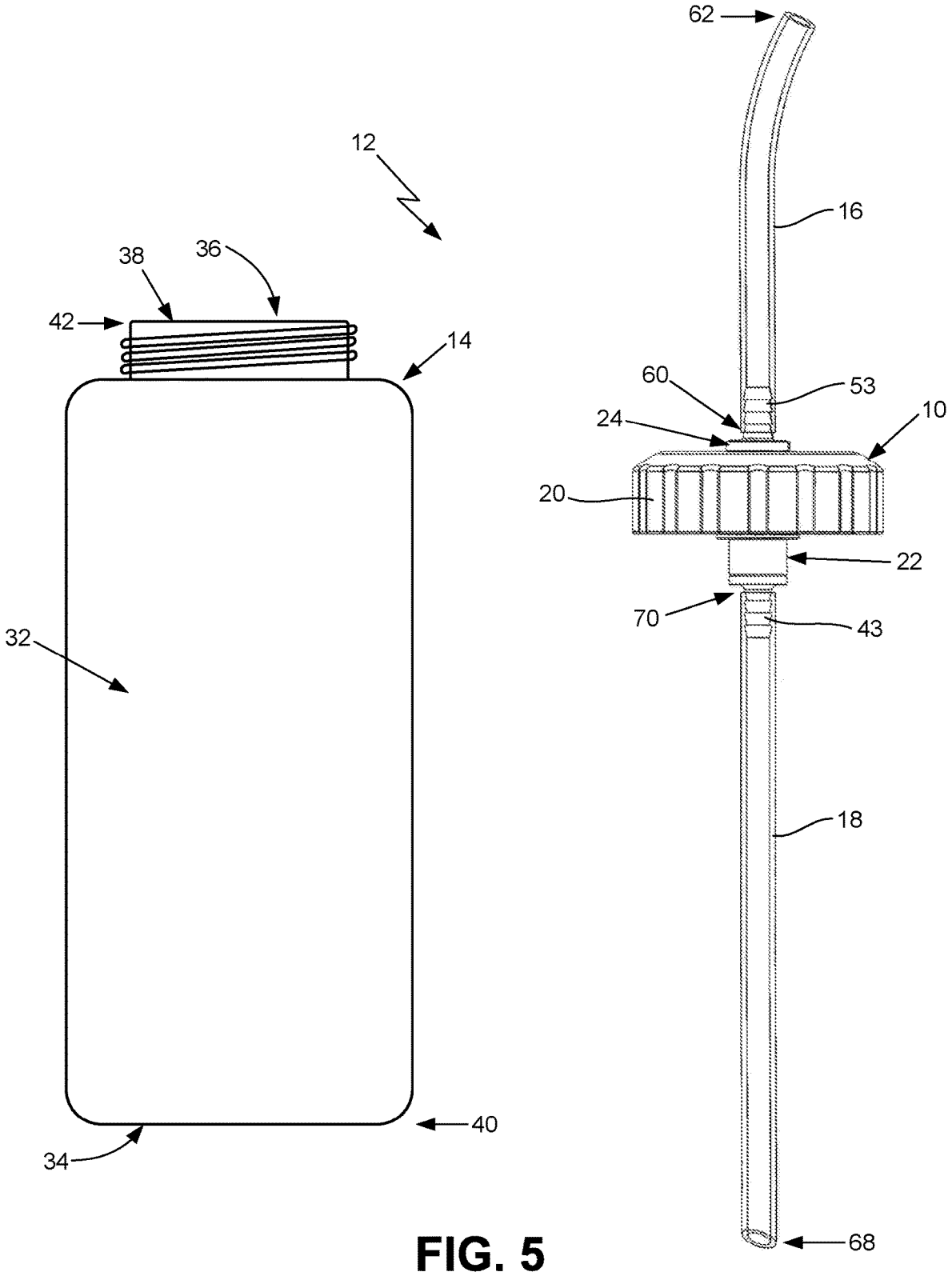
FIG. 5 is a side view of a liquid drinking system that comprises an alternative configuration of the hydration tube quick connect container lid of FIG. 1 showing use of an internally threaded cap member, a solid-walled drinking container, a hydration tube and an internal straw.

A container lid that is configured pursuant to preferred embodiments of the present invention is referred to generally as 10 in FIGS. 1-6 and 9-12. A liquid drinking system, which comprises the new container lid 10, that is configured pursuant to preferred embodiments of the present invention is referred to generally as 12 in FIGS. 1 and 5. As set forth in more detail below, the new container lid 10 of the present invention is structured and arranged to be utilized with a solid-walled drinking container 14 to allow a person to drink liquid from the drinking container 14 by use of a hydration tube 16, which is utilized by a person to draw liquid from the drinking container 14. As also set forth in more detail below, the new drinking system 12 comprises the new container lid 10, drinking container 14, hydration tube 16 and an internal straw 18, as shown in FIGS. 1 and 5.

Figure 2:
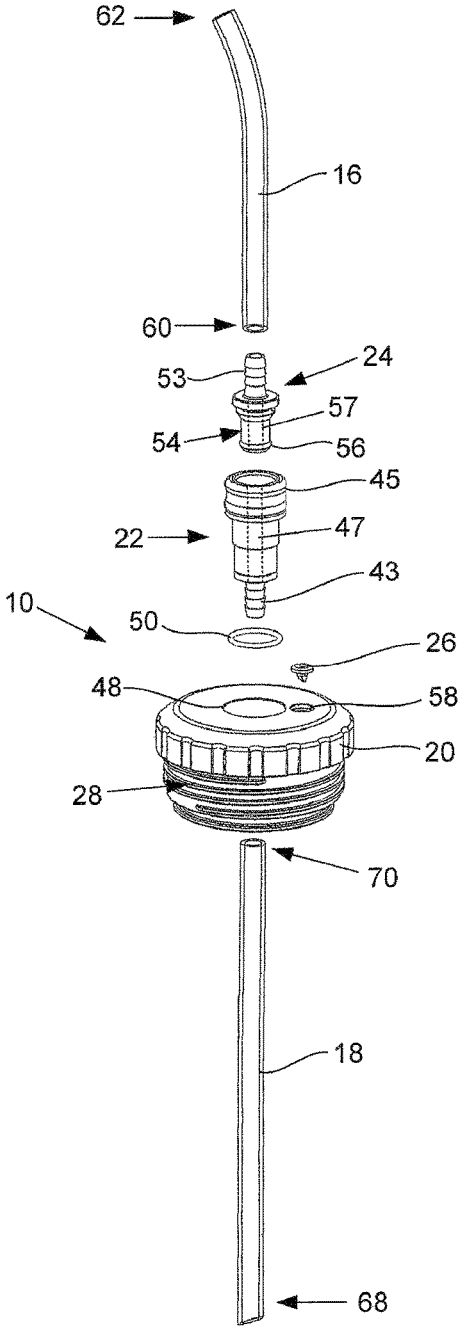
FIG. 2 is an exploded top perspective view of the container lid, hydration tube and internal straw of FIG. 1.
Figure 6:
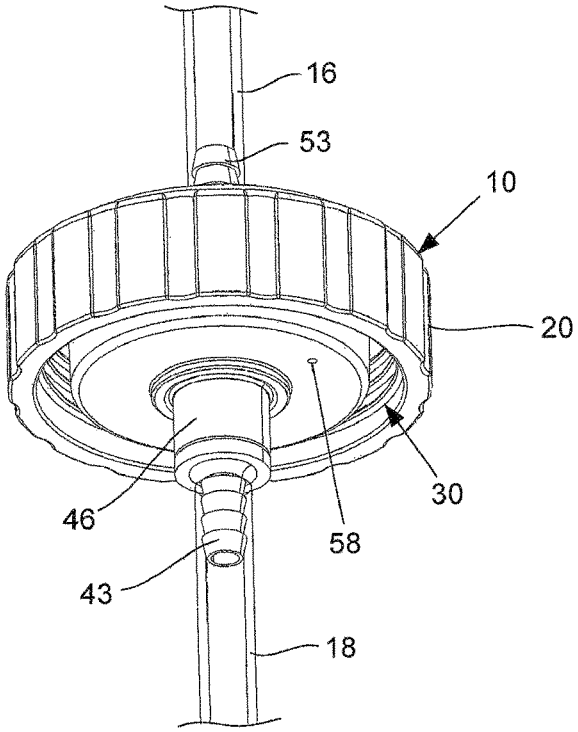
FIG. 6 is an isolated bottom perspective view of the container lid of FIG. 5 with portions of the hydration tube and internal straw connected thereto.
Figure 8:
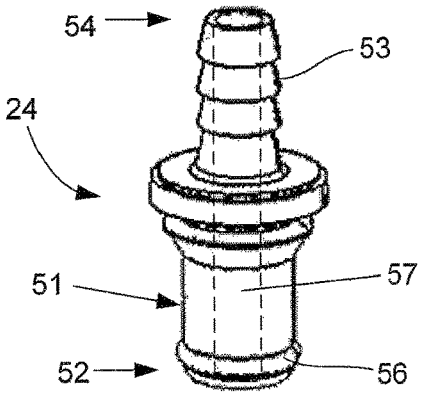
FIG. 8 is a side perspective view of the male insert of the container lid of FIGS. 1 and 5.
Figure 9:
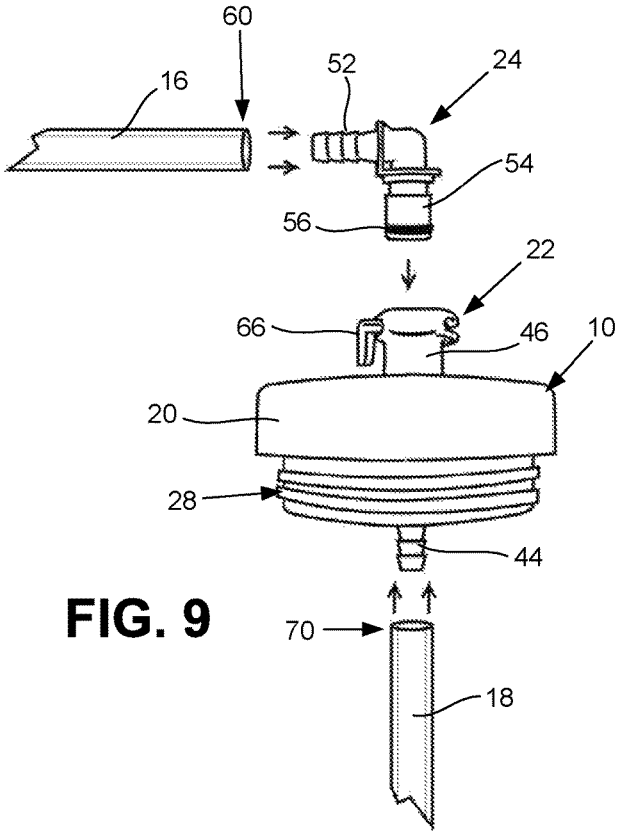
FIG. 9 is an exploded side view of a liquid drinking system that comprises a hydration tube quick connect container lid which is configured according to a second embodiment of the present invention, a solid-walled drinking container, a hydration tube and an internal straw.
Figure 10:
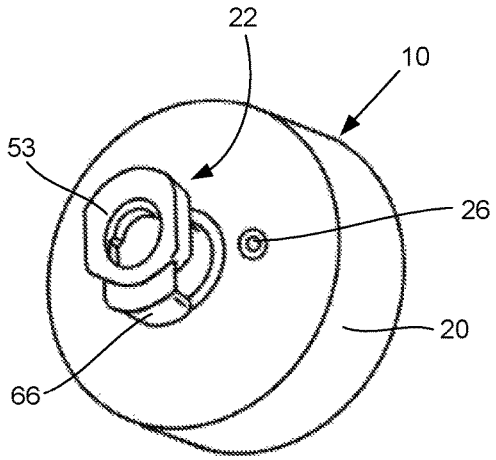
FIG. 10 is a top perspective view of the container lid of FIG. 9 particularly showing the female coupling and push button release device thereof.

The new container lid 10 generally comprises an insulating cap member 20, a barbed female coupling 22, a male insert 24 and a one-way check valve 26, as best shown in the perspective views of FIGS. 2-4, 6 and 8-10. In FIGS. 1-7, the container lid 10 is shown with the hydration tube 16 and internal straw 18. The cap member 20, which has a lower or downwardly facing surface 19 and an upper or upwardly facing surface 21 (as shown in FIGS. 3 and 4), can either be provided with external threads 28 (as shown in FIGS. 1-4, 7 and 9) or internal threads 30 (as shown in FIGS. 5-6 and 10). In either configuration, the cap member 20 is sized and configured to threadably engage and securely attach to the drinking container 14. In a preferred configuration, the drinking container 14 for use with container lid 10 and system 12 has one or more solid, rigid sidewalls 32 and a solid, rigid bottom wall 34 that define an interior chamber 36 in which the water or other liquid is stored and an opening 38 through which the liquid is placed into the interior chamber 36 of the drinking container 14. As will be readily appreciated by persons who are skilled in the art, the opening 38 is cooperatively configured cap member 20 to be either internal threaded (FIG. 1) or external threaded (FIG. 5) so as to be able to be threadably engaged by, respectively, either the external threads 28 or the internal threads 30 of the cap member 20. In FIGS. 1 and 5, the drinking container 14 is configured generally in a "water bottle" shape (i.e., a drinking bottle) having a closed first or lower end 40 and an open second or upper end 42, where the opening 38 is located. As will also be readily appreciated by persons who are skilled in the relevant arts, the drinking container 14 can have a wide variety of different shapes, be made out of a wide variety of different materials, contain a wide variety of different types of liquids and can be utilized for a wide variety of hydration purposes. For instance, in one configuration, the drinking container 14 can be a soft-walled drinking container, such as the previously described prior art pouch type of drinking container.

For purposes of describing the use and relative location of the various components of the present invention, the terms "upper", "upward", "upwardly", "upper" and "top" and the like and the terms "lower", "downward", "downwardly" and "bottom" and the like refer to the direction, respectively, to the relative positions of the components and the parts of the components, as well as the directions which the components are directed, with respect to the lower end 40 and upper end 42 of the drinking container 14 shown in FIGS. 1 and 5.

As set forth above, the insulating cap member 20 either has external threads 28 or internal threads 30 that are configured to interact and pair with the matching threads of the threaded opening 38 of the drinking container 14. The insulating cap member 20 is configured to secure the cap member 20 to a drinking container 14 and create an air tight seal that secures the contents inside the drinking container 14. In a preferred embodiment, as shown in FIGS. 1-3, 5-6, and 7-8, the barbed female coupling 22 is connected to or integrally formed at or near the center position of the cap member 20 and perpendicular to the cap member 20. As best shown in FIGS. 1-7, the female coupling 22 has a barb 43 at a lower end 44 thereof that is directed into the interior chamber 36 of drinking container 14 when the cap member 20 is attached to the drinking container 14 and a receptacle 45 at the opposite directed upper end 46, with the receptacle 45 facing upwardly from the cap member 20. As set forth in more detail below, the female coupling 22 has a flow path 47 therethrough (shown in FIGS. 2 and 7) that is opened by the selective application of a sucking force by the user (at the distal end of the hydration tube 16) and then closed when the suction action is removed (i.e., the user stops sucking on the hydration tube 16). In one configuration, the female coupling 22 has flap or like blocking member disposed in the flow path 47 between the lower end 44 and upper end 46 thereof that is moved to an open position, which allows liquid to flow through the female coupling 22, when an upward (i.e., from the direction of the upper end 46 of the female coupling 22) suction force is applied to the female coupling 22 and which moves to a closed position, which prevents liquid from flowing through the female coupling 22, upon removal or cessation of the suction force 24. In the figures, the female coupling 22 is securely positioned in a coupling aperture 48 formed in the cap member 20, as best shown in FIG. 1, with the barb 43 at the lower end 44 extending into the interior chamber 36 and the receptacle 45 at the upper end 46 facing upwardly from the upper surface of the cap member 20, as best shown with regards to FIGS. 3 and 4. As also shown in FIG. 1, an O-ring or other sealing device 50 is utilized to seal the female coupling 22 and coupling aperture 48 connection at the cap member 20. The configuration and use of a female coupling 22 such as described above (i.e., one that is selectively opened by application of a suction force) is generally well known in the relevant art.

The male insert 24, whether it is in-line straight shaped or elbow-shaped, has a sealing section 51 towards a lower end 52, a barb 53 at an upper end 54, a sealing device 56, such as an O-ring gasket or the like, mounted on or otherwise associated with the sealing section 51 and a flow path 57 therethrough between the lower end 52 and upper end 54, as best shown in FIGS. 2 and 8. The male insert 24, which allows liquid to pass therethrough, is sized and configured so as to be sealably coupled with the female coupling 22.

Specifically, the sealing section 51, with the sealing device 56 (i.e., O-ring gasket), of the male insert 24 is sized and configured in cooperative arrangement with the receptacle 56 at the upper end 46 of the female coupling 22 such that when the lower end 52 and sealing section 51 of the male insert 24 are received into the receptacle 56 of the female coupling 22, the flow path 57 of the male insert 24 connects to the flow path 47 through the female coupling 22 when the female coupling 22 is in its opened position (i.e., when suction is applied to the hydration tube 16). When the hydration tube 16 is connected to the male insert 24 and the user sucks on the hydration tube 16, the male insert 24 will hydraulically interconnect the hydration tube 16 with the flow path 47 through the female coupling 22 and the interior chamber 36 of the drinking container 14 while providing an air tight seal in the area between the outside wall of the male insert 24 and inside wall of the female coupling 22. As set forth above, the female coupling 22 is structured and arranged such that when the suction force is removed from the hydration tube 16 (i.e., when the user stops sucking on the hydration tube 16), the flow path 47 through the female coupling 22 closes to secure the liquid contents of the drinking container 14 inside the interior chamber 36 thereof.

The one-way check valve 26, best shown in FIGS. 2-3 and 8-10, is positioned in an air flow aperture 58 (FIGS. 2 and 6) of the cap member 20 and configured to allow the inflow of air into the interior chamber 36 of the drinking container 14 to replace the liquid contents of the drinking container 14 as the user drinks liquid from the drinking container 14. The check valve 26 is structured and arranged to not allow the back flow of air or liquid in the reverse direction in order to maintain an air tight seal. The elongated internal straw 18, shown in FIGS. 1-7, has a first or lower end 68 and a second or upper end 70, as best shown in FIGS. 1, 2 and 5. The second/upper end of the internal straw 18 is securely attached to the barb 43 of the lower end 44 of the female coupling 22 so as to extend the first/lower end 68 of the internal straw 18 generally downward into the interior chamber 36 of the drinking container 14. In a preferred configuration, the internal straw 18 is sized and configured to extend the entire length of the interior chamber 36 so as to position the first/lower end 68 thereof at least generally near the first/lower end 40 of the drinking container 14. The first or lower end 60 of the elongated hydration tube 16 is connected to the barb 53 at the upper end 54 of the male insert 24, as shown in FIGS. 1-3 and 5-6. As well known in the relevant art, the user will draw liquid from the interior chamber 36 of the drinking container 14 by sucking on the open second or upper end 62 of the hydration tube 16. The liquid will travel upward through the internal straw 18 and through the flow path 47 of the female coupling 22 and the flow path 57 of the male insert 24 inside the coupling aperture 48 of the cap member 20. Preferably, the insulating cap member 20 has an O-ring gasket or other cap sealing member to secure and maintain an air tight seal at the opening 38 of the drinking container 14 when cap member 20 is attached to drinking container 14. The configuration and use of such cap sealing members are well known to persons skilled in the relevant art. As will also be readily appreciated by such persons, the female coupling 22 and male insert 24 can be quickly disconnected from each other by the pull-away feature of the female coupling 22, which closes the flow path 47 through the female coupling 22. The male insert 24 has an O-ring gasket or other sealing member 52 on the sealing end 54 thereof to maintain an air tight seal between the male insert 24 and the female coupling 22 when the male insert 24 is coupled with female coupling 22. All materials should be selected so as to be tasteless and not impart any taste onto the liquid and should comprise materials which are known to be or have been certified to be safe for drinking.

One method of assembling and using the new container lid 10 comprises the following steps: (1) the second/upper end 70 of the internal straw 18 is connected to the barb 43 of the lower end 44 of the female coupling 22, which is located in the coupling aperture 48 of the cap member 20; (2) the insulating cap member 20 is threadably attached to the drinking container 14 to position the internal straw 18 inside the interior chamber 36 and close off the opening 38 of the drinking container 14; (3) the first/lower end 60 of the hydration tube 16 is attached to the barb 53 at the upper end 52 of the male insert 24; (4) the male insert 24 is coupled to the female coupling 22 by inserting the sealing section 51 and lower end of the male insert 24 into the receptacle 45 at the upper end 46 of the female coupling 22; and (5) the user obtains fluid from inside the interior chamber 36 by sucking on the open second/upper end 62 of the hydration tube 16. As set forth above, the sucking action by the user places the flow path 47 of the female coupling 22 in fluid flow communication with the flow path 57 of the male insert 24 (as well as hydraulically connecting the hydration tube 16, internal straw 18 and interior chamber 36). The liquid in the drinking container 14 will travel through the internal straw 18, the flow paths 47/57 of, respectively, the female coupling 22 and male insert 24 and the hydration tube 16 to the user's mouth. When connected together, the various components of the container lid 10 will maintain an air tight seal such that the liquid content of the drinking container 14 will only travel through the hydration tube 16 when a sucking force applied by the user on the open second/upper end 62 of the hydration tube 16 and will not otherwise leak or spill from the drinking container 14.

Referring to FIG. 1, shown is a side view of the liquid drinking system 12 that is configured according to one of the preferred embodiments of the present invention having a prior art solid-walled drinking container 14 and the new hydration tube quick connect container lid 10, for use with the solid-walled drinking container 14, along with the hydration tube 16 and internal straw 18 (with these components being configured in accordance with an exemplary configuration of the invention).

Referring to FIG. 2, shown is an exploded side perspective view of the hydration tube quick connect container lid 10 for the solid-walled drinking container 14, along with the hydration tube 16 and internal straw 18, in accordance with an exemplary embodiment of the invention shown in FIG. 1. As shown, the cap member 20 comprises a female coupling 22, having a barb 43 at its lower end 44, positioned in the coupling aperture 48 of the cap member 20. The insulated cap member 20 of this figure has external threads 28 to secure the cap member 20 to the internally threaded opening 38 of the solid-walled drinking container 14. The container lid 10 is shown with an inline, straight male insert 24 having barb 53 at the upper end 54 and sealing section 51 at the lower end 52 (with an O-ring or other sealing member 56). The sealing section 51 of the male insert 24 is cooperatively sized and configured with the receptacle 45 at the upper end 46 of the female coupling 22 to couple with the female coupling 22. The second/upper end 70 of the internal straw 18 attaches to the barb 43 at the lower end 44 of the female coupling 22 and, preferably, is of sufficient length to extend the first/lower end 68 thereof to the first/lower end 40 of the solid-walled drinking container 14. An elongated hydration tube 16, of the desired length, has a first/lower end 60 that is sized and configured to attach to the barb 53 of the inline male insert 24. The user sucks on the second/upper end 62 of the hydration tube 16 to draw liquid from the interior chamber 36 of the drinking container 14.

Referring to FIG. 3, this figure is a top perspective view of the insulated cap member 20 with a female coupling 22 positioned within the coupling aperture 48 of the cap member 20. As shown, the cap member 20 has a one-way check valve 26 that is positioned in the air flow aperture 58 of the cap member 20.

Referring to FIG. 4, this figure is a bottom perspective view of the cap member 20 having external threads 28 for threadably securing the cap member 20 to the opening 38 of the solid-walled drinking container 14. The barbed end 44 of the female coupling 22 extends downward below the cap member 20 into the interior chamber 36 of the drinking container 14 when the cap member 20 is attached to the drinking container 14. The air flow aperture 58 for the one-way check valve 26 is shown extending through the insulated cap member 20.

Referring to FIG. 5, this figure is a side view of an alternative configuration of the liquid drinking system 12 of the present invention having a prior art solid-walled drinking container 14 and the new hydration tube quick connect container lid 10, for use with the solid-walled drinking container 14, along with the hydration tube 16 and internal straw 18 (with these components being configured in accordance with an exemplary configuration of the invention). In this embodiment, the cap member 20 has internal threads 30 for threadably securing the cap member 20 to the externally threaded opening 38 of the solid-walled drinking container 14. As above, the barb 43 at the lower end 44 of the female coupling 22 extends downward below the cap member 20 so it will extend into the interior chamber 36 of the drinking container 14 when the cap member 20 is attached to the drinking container 14.

Referring to FIG. 6, this figure is a bottom perspective view of the cap member 20 having internal threads 30 of FIG. 5. The air flow aperture 58 for the one-way check valve 26 is shown extending through the insulated cap member 20.

Figure 7:
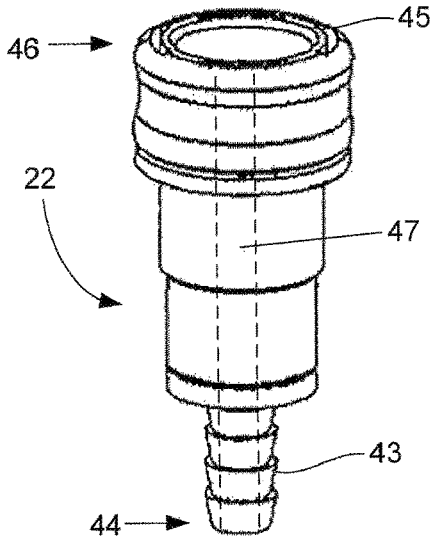
FIG. 7 is a side perspective view of the female coupling of the container lid of FIGS. 1 and 5.

Referring to FIG. 7, this figure is a side perspective view of the female coupling 22, particularly showing the downwardly extending barb 43 and the upwardly facing receptacle 45.

Referring to FIG. 8, this figure is a side perspective view of the male insert 24, particularly showing the downwardly extending sealing section 51 having the sealing device 56 (i.e., an O-ring) and an upwardly extending barb 53.

Referring to FIG. 9, this figure is an exploded view of a hydration tube quick connect container lid 10 for a solid-walled drinking container 14 that is configured in accordance with an alternative exemplary embodiment of the present invention. As shown, the insulated cap member 20 comprises a female coupling 22 having a barb 43 at the lower end 44 with a push button release device 66 received in the coupling aperture 48 of the cap member 20. The cap member 20 has external threads 28 to securely connect the cap member 20 to the opening 38 of the solid-walled drinking container 14. The elbow-shaped male insert 24, with barb 53 at the upper end 54 and a sealing section 51 (having O-ring 56) at the lower end 52, is sized and configured to be coupled with the receptacle 45 of female coupling 22. The internal straw 18 attaches to barb 43 at the lower end 44 of the female coupling 22 so as to, preferably, extend to or near the first/lower end 40 of the drinking container 14. The hydration tube 16 attaches to barb 53 at the upper end 52 of the male insert 24 and extends a desired length where the user can suck on the open second/upper end 62 of the hydration tube 16 to draw liquid from inside the drinking container 14.

Referring to FIG. 10, this figure is a top perspective view of the insulated cap member 20 from FIG. 9 with a female coupling 22 positioned within the coupling aperture 48 of the cap member 20. As shown, the cap member 20 has a one-way check valve 26 that is positioned in the air flow aperture 58 of the cap member 20.

Figure 11:
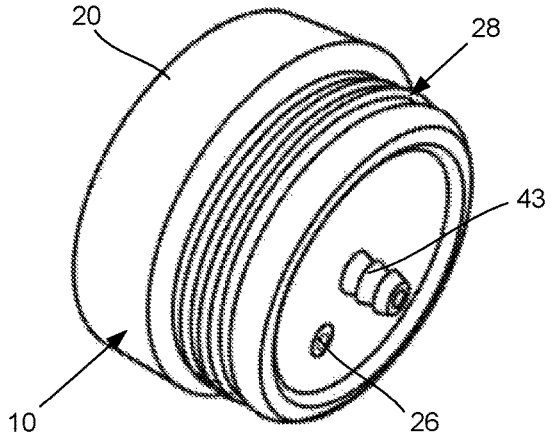
FIG. 11 is a bottom perspective view of the container lid of FIG. 10 particularly showing the externally threaded cap member.

Referring to FIG. 11, this figure is a bottom perspective view of the cap member 20 of FIG. 10 having external threads 28 for threadably securing the cap member 20 to the opening 38 of the solid-walled drinking container 14. The barb 43 at the lower end 44 of the female coupling 22 extends downward below the cap member 20 into the interior chamber 36 of the drinking container 14 when the cap member 20 is attached to the drinking container 14. The air flow aperture 58 for the one-way check valve 26 extends through the insulated cap member 20.

Figure 12:
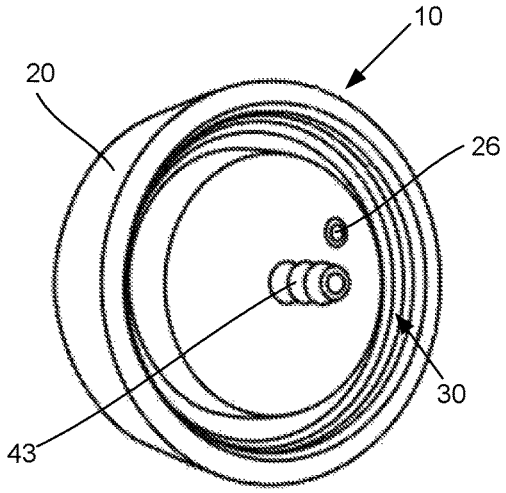
FIG. 12 is a bottom perspective view of an alternative configuration of the container lid of FIG. 10 showing use of an internally threaded insulated cap member.

Referring to FIG. 12, this figure is a bottom perspective view of a cap member 20 having internal threads 30 (as an alternative configuration) for threadably securing the cap member 20 to the solid-walled drinking container 14. As above, the barb 43 at the lower end 44 of the female coupling 22 extends downward below the cap member 20 into the interior chamber 36 of the drinking container 14 when the cap member 20 is attached to the drinking container 14. The air flow aperture 58 for the one-way check valve 26 is shown extending through the insulated cap member 20.

While there are shown and described herein various specific forms of the present invention, it will be readily apparent to those persons who are skilled in the relevant art that the invention is not so limited, but is susceptible to various modifications and rearrangements in design and materials without departing from the spirit and scope of the invention. In particular, it should be noted that the present invention is subject to modification with regard to any dimensional relationships that may be set forth herein and to modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention without any undue experimentation. Although, the described embodiments may comprise one or more different features, not all of these features are required in all embodiments of the present invention. More specifically, as will be readily appreciated by persons who are skilled in the relevant art, certain embodiments of the present invention only utilize some of the features and/or combinations of features disclosed herein.

What is claimed is:

1. A container lid for use with a drinking container having one or more rigid sidewalls defining an interior chamber inside the drinking container, the drinking container being closed at a lower end and having an opening at an upper end, said container lid comprising:

a cap member structured and arranged to attach to the drinking container at the opening thereof to close the interior chamber, said cap member having a coupling aperture therethrough;

a male insert having a flow path connecting an upper end and a lower end thereof, said upper end of said male insert attached to or integral with a hydration tube, said male insert having a sealing device associated with a downwardly extending sealing section at said lower end of said male insert and a female coupling disposed in said coupling aperture of said cap member, said female coupling having an upwardly facing receptacle at an upper end thereof, said receptacle sized and configured to removably receive said lower end and said sealing section of said male insert and to sealably engage said sealing device of said male insert when said lower end and said sealing section of said male insert is received in said receptacle, a lower end of said female coupling attached to or integral with an internal straw that extends downward in the interior chamber of the drinking container, said female coupling further comprising a flow path that interconnects said lower end and said upper end thereof, said cap member and said female coupling being structured and arranged to open said flow path of said female coupling to said internal straw and the interior chamber of the drinking container only when said sealing section of said male insert is received in said receptacle and suction is applied to said upper end of said female coupling from the hydration tube and through said flow path of said male insert and to close said flow path through said female coupling when suction is removed from the hydration tube and to prevent leakage from the interior chamber of the drinking container through said flow path of said female coupling when the hydration tube is removed from said container lid which causes said male insert to be removed from said receptacle.

2. The container lid of claim 1 further comprising an air flow aperture in said cap member and a one-way check valve disposed in said air flow aperture.

3. The container lid of claim 1 further comprising an upwardly extending barb at said upper end of said male insert, said upwardly extending barb being cooperatively sized and configured with the hydration tube for the hydration tube to be securely attached to said upwardly extending barb.

4. The container lid of claim 1 further comprising a downwardly extending barb at a lower end of said female coupling that extends into the interior chamber of the drinking container when said cap member is attached to the drinking container, said downward extending barb of said female coupling sized and configured to be securely attached to the internal straw.

5. The container lid of claim 1, wherein the hydration tube has a first end and a second end, the first end of the hydration tube sized and configured in cooperative arrangement with an upwardly extending barb at said upper end of said male insert, the second end of the hydration tube configured to receive a suction force applied by a person drinking liquid from the drinking container.

6. The container lid of claim 1, wherein said sealing device of said male insert is an O-ring.

7. The container lid of claim 1 further comprising a sealing device disposed between said female coupling and said coupling aperture.

8. The container lid of claim 1 further comprising a push button release device associated with said female coupling, said release device structured and arranged to release said male insert from said receptacle of said female coupling.

9. The container lid of claim 1, wherein said cap member is threadably attached to the opening of the drinking container.

10. A container lid for use with a drinking container having one or more rigid sidewalls defining an interior chamber inside the drinking container, the drinking container being closed at a lower end and having an opening at an upper end, said container lid comprising:

a cap member structured and arranged to attach to the drinking container at the opening thereof to close the interior chamber, said cap member having a coupling aperture therethrough;

a male insert having an upwardly extending barb at an upper end thereof and a sealing device associated with a downwardly extending sealing section at a lower end thereof, said upwardly extending barb sized and configured to be securely attached to a hydration tube, said male insert having a flow path connecting said upper end and said lower end thereof; and a female coupling disposed in said coupling aperture of said cap member, said female coupling having an upwardly facing receptacle at an upper end thereof and a downwardly extending barb at a lower end thereof that extends into the interior chamber of the drinking container when said cap member is attached to said drinking container, said receptacle sized and configured to removably receive said lower end and sealing section of said male insert and to sealably engage said sealing device of said male insert when said lower end and said sealing section of said male insert is received in said receptacle, said barb of said female coupling attached to or integral with an internal straw that extends downward in said interior chamber of the drinking container, said female coupling further comprising a flow path that interconnects said lower end and said upper end thereof, said cap member and said female coupling being structured and arranged to open said flow path of said female coupling to said internal straw and the interior chamber of the drinking container only when said sealing section of said male insert is received in said receptacle and suction is applied to said upper end of said female coupling from the hydration tube and through said flow path of said male insert and to close said flow path through said female coupling when suction is removed from the hydration tube and to prevent leakage from the interior chamber of the drinking container through said flow path of said female coupling when the hydration tube is removed from said container lid which causes said male insert to be removed from said receptacle.

11. The container lid of claim 10 further comprising an air flow aperture in said cap member and a one-way check valve disposed in said air flow aperture.

12. The container lid of claim 11 further comprising a sealing device disposed between said female coupling and said coupling aperture.

13. The container lid of claim 10 further comprising a push button release device associated with said female coupling, said release device structured and arranged to release said male insert from said receptacle of said female coupling.

14. The container lid of claim 10, wherein said cap member is threadably attached to the opening of the drinking container.

15. A liquid drinking system, comprising:

a drinking container having one or more rigid sidewalls defining an interior chamber, said drinking container being closed at a lower end thereof and having an opening at an upper end thereof;

a container lid having a cap member structured and arranged to attach said container lid to said drinking container at said opening thereof to close said interior chamber of said drinking container, said cap member having a coupling aperture therethrough;

an elongated hydration tube having a first end and a second end;

a male insert having an upper end and a lower end, said upper end of said male insert attached to or integral with said first end of said hydration tube, said male insert having a sealing device associated with a downwardly extending sealing section at said lower end thereof, said male insert having a flow path connecting said upper end and said lower end thereof;

an elongated internal straw having a first end and a second end; and a female coupling disposed in said coupling aperture of said cap member, said female coupling having an upwardly facing receptacle at an upper end thereof, said receptacle sized and configured to removably receive said lower end and sealing section of said male insert and sealably engage said sealing device of said male insert when said lower end and said sealing section of said male insert is received in said receptacle, a lower end of said female coupling being sized and configured to be attached to or integral with said second end of said internal straw so as to extend said internal straw downward in said interior chamber of said drinking container, said female coupling further comprising a flow path interconnecting said lower end and said upper end thereof, said cap member and said female coupling being structured and arranged to open said flow path of said female coupling to said internal straw and the interior chamber of the drinking container only when said sealing section of said male insert is received in said receptacle and suction is applied to said upper end of said female coupling from the hydration tube and through said flow path of said male insert and to close said flow path through said female coupling when suction is removed from the hydration tube and to prevent leakage from the interior chamber of the drinking container through said flow path of said female coupling when the hydration tube is removed from said container lid which causes said male insert to be removed from said receptacle.

16. The system of claim 15 further comprising an air flow aperture in said cap member and a one-way check valve disposed in said air flow aperture.

17. The system of claim 15 further comprising an upwardly extending barb at said upper end of said male insert, said upwardly extending barb sized and configured to be securely attached to said hydration tube.

18. The system of claim 17 further comprising a downwardly extending barb at a lower end of said female coupling that extends into said interior chamber of said drinking container when said cap member is attached to said drinking container, said downward extending barb of said female coupling sized and configured to be securely attached to said internal straw.

19. The system of claim 15 further comprising a sealing device disposed between said female coupling and said coupling aperture.

20. The system of claim 15, wherein said cap member is threadably attached to the opening of the drinking container.

* * * * *